US010662497B2

(12) United States Patent
Nakamura et al.

(10) Patent No.: US 10,662,497 B2
(45) Date of Patent: May 26, 2020

(54) AUSTENITIC STAINLESS STEEL AND METHOD OF MANUFACTURING THE SAME

(71) Applicant: NIPPON STEEL & SUMITOMO METAL CORPORATION, Tokyo (JP)

(72) Inventors: Jun Nakamura, Nishinomiya (JP); Tomohiko Omura, Kishiwada (JP); Hiroyuki Hirata, Neyagawa (JP); Kana Jotoku, Amagasaki (JP); Takahiro Osuki, Takarazuka (JP)

(73) Assignee: NIPPON STEEL CORPORATION, Tokyo (JP)

( * ) Notice: Subject to any disclaimer, the term of this patent is extended or adjusted under 35 U.S.C. 154(b) by 287 days.

(21) Appl. No.: 15/520,451

(22) PCT Filed: Oct. 22, 2015

(86) PCT No.: PCT/JP2015/079800

§ 371 (c)(1),
(2) Date: Apr. 20, 2017

(87) PCT Pub. No.: WO2016/068009

PCT Pub. Date: May 6, 2016

(65) Prior Publication Data

US 2017/0314092 A1 Nov. 2, 2017

(30) Foreign Application Priority Data

Oct. 29, 2014 (JP) ..... 2014-220553

(51) Int. Cl.

| | |
|---|---|
| ***C21D 9/46*** | (2006.01) |
| ***C22C 38/58*** | (2006.01) |
| ***C22C 38/00*** | (2006.01) |
| ***C21D 8/00*** | (2006.01) |
| ***C22C 38/04*** | (2006.01) |
| ***C22C 38/08*** | (2006.01) |
| ***C22C 38/12*** | (2006.01) |
| ***C21D 6/00*** | (2006.01) |
| ***C21D 8/02*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |

(52) U.S. Cl.

CPC ..... *C21D 9/46* (2013.01); *C21D 6/004* (2013.01); *C21D 6/005* (2013.01); *C21D 6/008* (2013.01); *C21D 8/005* (2013.01); *C21D 8/0205* (2013.01); *C21D 8/0236* (2013.01); *C21D 8/0268* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/44* (2013.01); *C22C 38/46* (2013.01); *C22C 38/48* (2013.01); *C22C 38/58* (2013.01); *C21D 2211/001* (2013.01); *C21D 2211/004* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 10,266,909 | B2 * | 4/2019 | Omura | C21D 6/008 |
| 2014/0017111 | A1 * | 1/2014 | Omura | C22C 38/001 420/40 |

FOREIGN PATENT DOCUMENTS

| | | | | |
|---|---|---|---|---|
| CA | 2 901 742 | | 9/2014 | |
| JP | 2009084597 | A * | 4/2009 | |
| JP | 5131794 | | 1/2013 | |
| WO | 2004/083476 | | 9/2004 | |
| WO | 2004/083477 | | 9/2004 | |
| WO | 2004/111285 | | 12/2004 | |
| WO | WO-2012132992 | A1 * | 10/2012 | C22C 38/001 |

OTHER PUBLICATIONS

ASTM Table E112-96 (2004) (Year: 2004).*

* cited by examiner

*Primary Examiner* — Keith D. Hendricks
*Assistant Examiner* — Jophy S. Koshy
(74) *Attorney, Agent, or Firm* — Clark & Brody LP

(57) ABSTRACT

A high-strength austenitic stainless steel, which has good hydrogen embrittlement resistance and hydrogen fatigue resistance, has a chemical composition including, in mass %, C: up to 0.10%; Si: up to 1.0%; Mn: not less than 3.0% and less than 7.0 %; Cr: 15 to 30%; Ni: not less than 12.0% and less than 17.0%; Al: up to 0.10%; N: 0.10 to 0.50%; P: up to 0.050%; S: up to 0.050%; at least one of V: 0.01 to 1.0% and Nb: 0.01 to 0.50%; and other elements, the balance being Fe and impurities, wherein the ratio of the minor axis to the major axis of the austenite crystal grains is greater than 0.1, the crystal grain size number of austenite crystal grains is not lower than 8.0, and the tensile strength is not less than 1000 MPa.

3 Claims, 2 Drawing Sheets

AUSTENITIC STAINLESS STEEL AND METHOD OF MANUFACTURING THE SAME

TECHNICAL FIELD

The present invention relates to an austenitic stainless steel and a method of manufacturing such a stainless steel, and more particularly to an austenitic stainless steel having a high strength and a good hydrogen embrittlement resistance and hydrogen fatigue resistance required of a member such as a valve or joint exposed to high-pressure hydrogen gas, and a method of manufacturing such a stainless steel.

BACKGROUND ART

Research is under progress for developing fuel-cell vehicles that use hydrogen as a fuel to travel, and deploying hydrogen stations that supply hydrogen to such fuel-cell vehicles. Stainless steel is one of the candidate materials that can be used for such applications. However, in a high-pressure hydrogen gas environment, even stainless steel may be embrittled by hydrogen gas (hydrogen-environment embrittlement). The standards for pressurized-hydrogen containers for automobiles specified by the High-Pressure Gas Safety Law permit the use of SUS316L as a stainless steel that does not suffer from hydrogen-environment embrittlement.

However, in order to achieve light-weight fuel-cell vehicles and compact hydrogen stations and address the necessity of high-pressure operation of hydrogen stations, it is desired that a stainless steel for use in a container or joint or piping do not suffer from hydrogen-environment embrittlement in a hydrogen-gas environment and have a high strength not lower than SUS316L, as is conventional. In recent years, high-strength steels have been proposed that have a high N content and use the resulting solute strengthening and fine-particle nitrides, as disclosed in WO 2004/111285, WO 2004/083477, WO 2004/083476, and Japanese Patent No. 5131794.

DISCLOSURE OF THE INVENTION

Materials with still higher strengths than the high-strength steels described in the above patent documents are desired. Cold working is known as a means of increasing the strength of austenitic stainless steel. However, cold-worked austenitic stainless steel has significantly decreased hydrogen embrittlement resistance. Especially, in austenitic stainless steels with high N contents, which have low stacking fault energy, strains during deformation may be localized, resulting in a still more significant decrease in hydrogen embrittlement resistance. Accordingly, it is believed that cold working for increasing strength cannot be applied to a material that is intended for use in a high-pressure hydrogen environment.

Further, a member that is exposed to high-pressure hydrogen gas such as a pipe or valve in a hydrogen station is used in an environment in which hydrogen gas pressure varies. Accordingly, a certain resistance to fatigue that may be caused by varying hydrogen gas pressure (hereinafter referred to as "hydrogen fatigue resistance") is desirable, but the above-listed patent documents do not consider hydrogen fatigue resistance. That is, there is no material that has good strength, good hydrogen embrittlement resistance and good hydrogen fatigue resistance.

The present invention was made in view of the current circumstances described above. An object of the present invention is to provide a high-strength austenitic stainless steel having good hydrogen embrittlement resistance and hydrogen fatigue resistance.

An austenitic stainless steel according to the present invention has a chemical composition consisting of, in mass %, C: up to 0.10%; Si: up to 1.0%; Mn: not less than 3.0% and less than 7.0%; Cr: 15 to 30%; Ni: not less than 12.0% and less than 17.0%; Al: up to 0.10%; N: 0.10 to 0.50%; P: up to 0.050%; S: up to 0.050%; at least one of V: 0.01 to 1.0% and Nb: 0.01 to 0.50%; Mo: 0 to 3.0%; W: 0 to 6.0%; Ti: 0 to 0.5%; Zr: 0 to 0.5%; Hf; 0 to 0.3%; Ta: 0 to 0.6%; B: 0 to 0.020%; Cu: 0 to 5.0%; Co: 0 to 10.0%; Mg: 0 to 0.0050%; Ca: 0 to 0.0050%; La: 0 to 0.20%; Ce: 0 to 0.20%; y: 0 to 0.40%; Sm: 0 to 0.40%; Pr: 0 to 0.40%; Nd: 0 to 0.50%; and the balance being Fe and impurities, the steel having an austenite crystal grain with a ratio of a minor axis to a major axis that is greater than 0.1, the austenite crystal grain having a crystal grain size number that is not lower than 8.0, the steel having a tensile strength that is not less than 1000 MPa.

A method of manufacturing an austenitic stainless steel according to the present invention includes the steps of; preparing a steel material having a chemical composition consisting of, in mass %, C: up to 0.10%; Si: up to 1.0%; Mn: not less than 3.0% and less than 7.0%; Cr: 15 to 30%; Ni: not less than 12.0% and less than 17.0%; Al: up to 0.10%; N: 0.10 to 0.50%; P: up to 0.050%; S; up to 0.050%; at least one of V: 0.01 to 1.0% and Nb: 0.01 to 0.50%; Mo: 0 to 3.0%; W: 0 to 6.0%; Ti: 0 to 0.5%; Zr; 0 to 0.5%; Hf: 0 to 0.3%; Ta: 0 to 0.6%; B; 0 to 0.020%; Cu: 0 to 5.0%; Co: 0 to 10.0%; Mg; 0 to 0.0050%; Ca: 0 to 0.0050%; La: 0 to 0.20%; Ce: 0 to 0.20%; Y: 0 to 0.40%; Sm: 0 to 0.40%; Pr: 0 to 0.40%; Nd: 0 to 0.50%; and the balance being Fe and impurities; performing a solution treatment on the steel material at a solution treatment temperature of 1000 to 1200° C.; cold working the steel material that has undergone the solution treatment with a reduction in area that is not lower than 20%; performing a heat treatment on the steel material that has been cold-worked at a temperature that is not lower than 900° C. and lower than the solution treatment temperature; and cold working the steel material that has undergone the heat treatment with a reduction in area that is not lower than 10% and lower than 65%.

The present invention provides a high-strength austenitic stainless steel with good hydrogen embrittlement resistance and hydrogen fatigue resistance.

EMBODIMENTS FOR CARRYING OUT THE INVENTION

Figure 1:
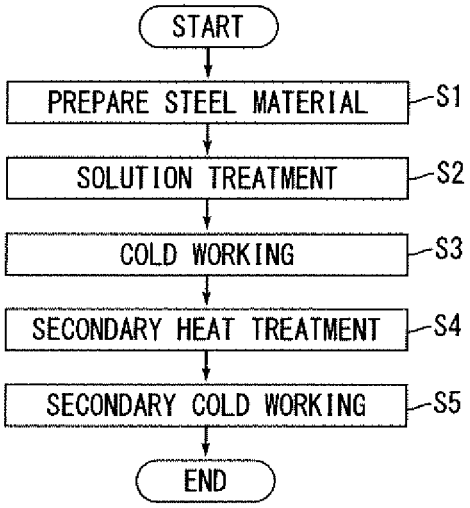
FIG. 1 is a flow chart of a method of manufacturing an austenitic stainless steel according to an embodiment of the present invention.

The present inventors attempted to find a way of increasing the strength of austenitic stainless steel while maintaining hydrogen embrittlement resistance and hydrogen fatigue resistance. They obtained the following findings, (a) and (b).

(a) Those ones of the austenitic stainless steels described in U.S. Pat. No. 5,131,794 that have an Ni content of 12.0% or higher are suitable as steel base material.

(b) These austenitic stainless steels should further be cold-worked with a reduction in area that is not lower than 10% and lower than 65%. This will provide an austenitic stainless steel having a high strength of 1000 MPa or higher and having good hydrogen embrittlement resistance and hydrogen fatigue resistance without excess anisotropy in cold-worked crystal grains.

Traditionally, it has been believed that cold working an austenitic stainless steel may cause strain-induced transformation or deformation of crystal grains, which will prevent hydrogen embrittlement resistance and hydrogen fatigue resistance from being maintained. However, the investigation of the present inventors demonstrated that, in a steel with fine carbonitride precipitations, the pinning effect prevents crystal grains from being deformed. It was also demonstrated that, if, in addition, Ni content is 12.0% or higher, then, good hydrogen embrittlement resistance and hydrogen fatigue resistance can be maintained even if the steel is cold-worked with a reduction in area that is not lower than 10% and lower than 65%.

The austenitic stainless steel of the present invention was made based on the above-discussed findings. The austenitic stainless steel according to an embodiment of the present invention will now be described in detail.

[Chemical Composition of Steel]

The austenitic stainless steel according to the present embodiment has the chemical composition described below. In the description below, "%" for the content of an element means mass %.

C: Up to 0.10%

Carbon (C) is not an element that is intentionally added according to the present embodiment. If C content exceeds 0.10%, carbides precipitate on grain boundaries, which may adversely affect toughness and other properties. In view of this, C content should be not higher than 0.10%. C content is preferably not higher than 0.04%, and more preferably not higher than 0.02%. The lower C content, the better; however, reducing C content excessively involves increased refining costs, and thus, for practical reasons, it is preferable that C content is not lower than 0.001%.

Si: Up to 1.0%

Silicon (Si) deoxidizes steel. However, if a large amount of Si is contained, it may, together with Ni, Cr and/or other elements, form intermetallic compounds, or facilitate formation of intermetallic compounds such as o-phase, which may significantly decrease hot workability. In view of this, Si content should be not higher than 1.0%. Si content is preferably not higher than 0.5%. The lower Si content, the better; still, from the view point of refining costs, it is preferable that Si content is not lower than 0.01%.

Mn: Not Less than 3.0% and Less than 7.0%

Manganese (Mn) is an inexpensive austenite-stabilizing element. According to the present embodiment, Mn is combined appropriately with Cr, Ni, N and/or other elements to contribute to increase in strength and improvement of ductility and toughness. Further, according to the present embodiment, fine-particle precipitation of carbonitrides produces fine crystal grains; however, if the amount of dissolved N is small, carbonitrides with sufficient number density cannot be precipitated even after the process made up of a solution treatment, cold working and secondary heat treatment, described further below. Mn has the effect of increasing solubility of N; in view of this, Mn content should be not lower than 3.0%. On the other hand, if Mn content is not lower than 7.0%, the technique described in WO 2004/083477 can be applied; in view of this, according to the present embodiment, Mn content should be lower than 7.0%. Thus, Mn content is not lower than 3.0% and lower than 7.0%. The lower limit for Mn content is preferably 4%. The upper limit for Mn content is preferably 6.5%, and more preferably 6.2%.

Cr: 15 to 30%

Chromium (Cr) is an element that provides sufficient corrosion resistance for producing a stainless steel, and thus is an essential component. On the other hand, excess Cr content facilitates production of large amounts of coarse particles of carbides such as $M_{23}C_6$, which may decrease ductility and toughness. In view of this, Cr content should be in the range of 15 to 30%. The lower limit for Cr content is preferably 18%, and more preferably 20%. The upper limit for Cr content is preferably 24%, and more preferably 23.5%.

Ni: Not Less than 12.0% and Less than 17.0%

Nickel (Ni) is added as an austenite-stabilizing element. According to the present embodiment, Ni is combined appropriately with Cr, Mn, N and/or other elements to contribute to increase in strength and improvement of ductility and toughness. If Ni content is lower than 12.0%, cold working may cause the stability of the austenite to decrease. On the other hand, if Ni content is not lower than 17.0%, the steel is saturated with respect to Ni's effects described above, which means increases in material costs. In view of this, Ni content should be not lower than 12.0% and lower than 17.0%. The lower limit for Ni content is preferably 13%, and more preferably 13.5%. The upper limit for Ni content is preferably 15%, and more preferably 14.5%.

Al: Up to 0.10%

Aluminum (Al) deoxidizes steel. On the other hand, excess Al content facilitates production of intermetallic compounds such as a-phase. In view of this, Al content should be not higher than 0.10%. To ensure that the steel is deoxidized, Al content is preferably not lower than 0.001%. The upper limit for Al content is preferably 0.05%, and more preferably 0.03%. Al as used herein means so-called "sol.Al (acid-soluble Al)".

N: 0.10 to 0.50%

Nitrogen (N) is the most important solute-strengthening element and, at the same time, according to the present embodiment, produces fine crystal grains by forming fine particles of alloying carbonitrides, thereby contributing to increase in strength. On the other hand, excess N content may result in coarse nitride particles, decreasing toughness and other mechanical properties. In view of this, N content should be in the range of 0.10 to 0.50%. The lower limit for N content is preferably 0.20%, and more preferably 0.30%.

V: 0.01 to 1.0% and/or Nb: 0.01 to 0.50%

Vanadium (V) and niobium (Nb) promote production of alloying carbonitrides and contribute to making crystal grains finer; in view of this, one or both of them are contained. On the other hand, if excessive amounts of these elements are contained, the steel will saturated with respect to their effects, which means increases in material costs. In view of this, V content should be in the range of 0.01 to 1.0%, and Nb content in the range of 0.01 to 0.50%. The lower limit for V content is preferably 0.10%. The upper limit for V content is preferably 0.30%. The lower limit for Nb content is preferably 0.15%. The upper limit for Nb content is preferably 0.28%. It is more effective if both V and Nb are contained.

P: Up to 0.050%

Phosphorus (P) is an impurity and may adversely affect the toughness and other properties of steel. P content should be not higher than 0.050%, where the lower P content, the better. P content is preferably not higher than 0.025%, and more preferably not higher than 0.018%.

S: Up to 0.050%

Sulfur (S) is an impurity, and may adversely affect the toughness and other properties of steel. S content should be not higher than 0.050%, where the lower S content, the better. S content is preferably not higher than 0.010%, and more preferably not higher than 0.005%.

The balance of the chemical composition of the austenitic stainless steel according to the present embodiment is Fe and impurities. Impurity as used herein means an element originating from ore or scraps used as a raw material of a steel being manufactured on an industrial basis or an element that has entered from the environment or the like during the manufacturing process.

The austenitic stainless steel according to the present embodiment may have a chemical composition including, instead of some of Fe described above, one or more elements selected form one of the first to fourth groups provided below. All of the elements belonging to the first to fourth groups provided below are optional elements. That is, the elements belonging to the first to fourth groups provided below need not be contained in the austenitic stainless steel according to the present embodiment. Only one or some of these elements may be contained.

More specifically, for example, only one of the first to fourth groups may be selected and one or more elements may be selected from this group. In this case, not all of the elements belonging to the selected group need be selected. Alternatively, a plurality of groups may be selected from the first to fourth groups and one or more elements may be selected from each of these groups. Again, not all of the elements belonging to the selected groups need be selected.

[First Group]

Mo: 0 to 3.0%

W: 0 to 6.0%

The elements belonging to the first group are molybdenum (Mo) and Tungsten (W). These elements have the common effects of promoting production and stabilization of carbonitrides and contributing to solute strengthening. On the other hand, if excess amounts thereof are contained, the steel is saturated with respect to their effects. In view of this, the upper limit for Mo should be 3.0% and that for W should be 6.0%. The preferred lower limit for these elements is 0.3%.

[Second Group]

Ti: 0 to 0.5%

Zr: 0 to 0.5%

Hf: 0 to 0.3%

Ta: 0 to 0.6%

The elements belonging to the second group are titanium (Ti), zirconium (Zr), hafnium (Hf), and tantalum (Ta). These elements have the common effects of promoting production of carbonitrides and producing fine crystal grains. On the other hand, if excess amounts thereof are contained, the steel is saturated with respect to their effects. In view of this, the upper limit for Ti and Zr is 0.5%, that for Hf is 0.3%, and that for Ta is 0.6%. The upper limit for Ti and Zr is preferably 0.1%, and more preferably 0.03%. The upper limit for Hf is preferably 0.08%, and more preferably 0.02%. The upper limit for Ta is preferably 0.4%, and more preferably 0.3%. The preferred lower limit for these elements is 0.001%.

[Third Group]

B: 0 to 0.020%

Cu: 0 to 5.0%

Co: 0 to 10.0%

The elements belonging to the third group are boron (B), copper (Cu) and cobalt (Co). These elements have the common effect of contributing to increase in the strength of steel. B increases the strength of steel by producing fine precipitates and thus fine crystal grains. On the other hand, if excess B is contained, it may cause compounds with low melting points to be formed, decreasing hot workability. In view of this, the upper limit for B content is 0.020%. Cu and Co are austenite-stabilizing elements, and increase the strength of steel by solute strengthening. On the other hand, if excess amounts thereof are contained, the steel is saturated with respect to their effects. In view of this, the upper limit for Cu is 5.0% and that for Co is 10.0%. The preferred lower limit for B is 0.0001% and the preferred lower limit for Cu and Co is 0.3%.

[Fourth Group]

Mg: 0 to 0.0050%

Ca: 0 to 0.0050%

La: 0 to 0.20%

Ce: 0 to 0.20%

Y: 0 to 0.40%

Sm: 0 to 0.40%

Pr: 0 to 0.40%

Nd: 0 to 0.50%

The elements belonging to the fourth group are magnesium (Mg), calcium (Ca), lanthanum (La), cerium (Ce), yttrium (Y), samarium (Sm), praseodymium (Pr), and neodymium (Nd). These elements have the common effect of preventing solidification cracking during casting of the steel. On the other hand, excess contents thereof decrease hot workability. In view of this, the upper limit for Mg and Ca is 0.0050%, that for La and Ce is 0.20%, that for Y, Sm and Pr is 0.40%, and that for Nd is 0.50%. The preferred lower limit for these elements is 0.0001%.

[Internal Microstructure of Steel]

Although nitrogen is effective in solute strengthening, it lowers stacking fault energy to localize strains during deformation, which may decrease the durability against embrittlement in a hydrogen environment. Further, as discussed further below, while the present embodiment attempts to strengthen steel by cold working, cold working may increase dislocation density and increase the amount of trapped hydrogen, which may decrease the durability against embrittlement in a hydrogen environment.

According to the present embodiment, the microstructure present after cold working performed after the secondary heat treatment described further below (hereinafter referred to as secondary cold working) is adjusted to increase the strength up to 1500 MPa and, at the same time, prevent embrittlement in a hydrogen environment. More specifically, the ratio of the minor axis (B) to the major axis (A) of austenite crystal grains, B/A, is made greater than 0.1 to provide good hydrogen embrittlement resistance in a cold-worked microstructure.

In order to make the ratio of the minor axis to the major axis of austenite crystal grains after the secondary cold working greater than 0.1, the microstructure before the secondary cold working must be controlled; to do this, pinning using alloying carbonitrides is effective. To obtain this effect, it is preferable to cause $0.4/\mu m^2$ or more particles (on an observed cross section) of alloying carbonitrides with a dimension of 50 to 1000 nm to be precipitated. These alloying carbonitrides contain Cr, V, Nb, Mo, W, Ta, etc. as main components and have a crystal microstructure of a Z phase, i.e. Cr (Nb, V) (C, N) and MX type (M: Cr, V, Nb, Mo, W, Ta, etc., X: C, N). The alloying carbonitrides according to the present embodiment contain almost no Fe, where the amount of Fe, if contained at all, is at most 1 atom %. The carbonitrides according to the present embodiment may have an extremely low C (carbon) content, i.e. may be nitrides.

In addition, austenite crystal grains of the austenitic stainless steel according to the present embodiment have a crystal grain size number in accordance with ASTM E 112 that is not lower than 8.0. Making the crystal grains finer increases the resistance of a high-nitrogen steel to embrittlement in a hydrogen environment.

Even if a steel contains the above microstructure, it may have low resistance to embrittlement in a hydrogen environment if it has a low Ni content. Further, even if the microstructure before cold working is austenite, which has good hydrogen embrittlement resistance, cold working may cause a martensite phase to form, which may deteriorate hydrogen embrittlement resistance. Ni is contained according to the present embodiment to improve the stability of austenite: the Ni content is 12.0% or higher according to the present embodiment to provide sufficient stability of austenite against cold working with a large working ratio.

The tensile strength of an austenitic stainless steel according to the present embodiment is not smaller than 1000 MPa, and preferably not smaller than 1200 MPa. On the other hand, a tensile strength of 1500 MPa or greater may increase the anisotropy of crystal grains, making it difficult to provide sufficient hydrogen embrittlement resistance. Thus, to define an upper limit, tensile strength is preferably smaller than 1500 MPa.

[Manufacturing Method]

A method of manufacturing the austenitic stainless steel according to an embodiment of the present invention will now be described.

With conventional methods, it is impossible to make the crystal grains finer and cause suitable fine alloying carbonitrides with a desired number density to precipitate before the secondary cold working; however, it becomes possible by, for example, successively performing the solution treatment, cold working, secondary heat treatment described below.

FIG. 1 is a flow chart of the method of manufacturing the austenitic stainless steel according to the present embodiment. The method of manufacturing the austenitic stainless steel according to the present embodiment includes the step of preparing a steel material (step S1); performing solution treatment on the steel material (step S2); cold working the steel material that has undergone the solution treatment (step 3); performing a secondary heat treatment on the steel material that has been cold-worked (step S4); and performing a secondary cold working on the steel material that has undergone the secondary heat treatment (step S5).

A steel having the above-described chemical composition (hereinafter referred to as steel material) is prepared (step S1). More specifically, for example, the steel with the above-described chemical composition is smelt and refined. It is also possible that the steel material may be a refined steel that has been subjected to hot working such as hot forging, hot rolling or hot extrusion.

The steel material is subjected to solution treatment (step S2). More specifically, the steel material is held at a temperature of 1000 to 1200° C. (hereinafter referred to as solution treatment temperature) for a predetermined period of time, and then cooled. To cause the alloying elements to dissolve sufficiently, the solution treatment temperature is not lower than 1000° C., and more preferably not lower than 1100°. On the other hand, if the solution treatment temperature is higher than 1200° C., crystal grains become extremely coarse.

In the solution treatment according to the present embodiment, it is sufficient if solution occurs to a degree necessary to cause carbonitrides to precipitate in the later secondary heat treatment (step S4), and not all the carbonitride-forming elements need be dissolved. It is preferable that the steel material that has undergone the solution treatment is rapidly cooled from the solution treatment temperature, preferably water-cooled (showered or dipped).

Further, the step of solution treatment (step S2) need not be an independent step: similar effects can be obtained by rapid cooling after the step of hot working such as hot extrusion. For example, rapid cooling may occur after hot extrusion at about 1150° C.

The steel material that has been subjected to solution treatment is cold worked (step S3). The cold working may be, for example, cold rolling, cold forging, or cold drawing. The reduction in area for the cold working is 20% or higher. This increases precipitation nuclei for carbonitrides in the steel. There is no specific upper limit for the reduction in area for the cold working; however, considering reductions in area applied to normal parts, a reduction of 90% or lower is preferred. As used herein, reduction in area (%) is (cross section of steel material before cold working−cross section of steel material after cold working)×100/(cross section of steel material before cold working).

The steel material that has been cold-worked is subjected to the secondary heat treatment (step S4). More specifically, the steel material that has been cold-worked is held at a temperature that is not lower than 900° C. and lower than the solution treatment temperature of step S2 (hereinafter referred to as secondary heat treatment temperature) for a predetermined period of time, and then cooled. The secondary heat treatment removes strains due to the cold working and causes fine particles of carbonitrides to precipitate, resulting in fine crystal grains.

As described above, the secondary heat treatment temperature is lower than the solution treatment temperature. To achieve still finer crystal grains, the secondary heat treatment temperature is preferably not higher than [solution treatment temperature—20° C.], and more preferably not higher than [solution treatment temperature—50° C.]. The secondary heat treatment temperature is preferably not higher than 1150° C., and more preferably not higher than 1080° C. On the other hand, if the secondary heat treatment temperature is lower than 900° C., coarse Cr carbide particles are produced, resulting in a non-uniform microstructure.

The steel material that has undergone the secondary heat treatment is subjected to the secondary cold working (step S5). The secondary cold working may be, for example, cold rolling, cold forging or cold drawing. The reduction in area for the secondary cold working is not lower than 10% and lower than 65%. If the reduction in area for the secondary cold working is not lower than 65%, the material anisotropy and the stability of austenite decrease, which decreases the hydrogen embrittlement resistance and the fatigue life in hydrogen. According to the present embodiment, increasing the content of Ni, which is an element that increases the stability of austenite, and the pinning effect of carbonitrides provide a desired hydrogen embrittlement resistance and hydrogen fatigue resistance even though the reduction in area is relative high. This will increase strength and, at the same time, prevent embrittlement in a hydrogen environment. To define a lower limit, the reduction in area for the secondary cold working is preferably higher than 30%, and more preferably not lower than 40%.

Examples

The present invention will now be described in more detail by means of examples. The present invention is not limited to these examples.

50 kg stainless steels having the chemical compositions shown in Table 1 were vacuum-melt and hot-forged into blocks with a thickness of 40 to 60 mm.

TABLE 1

| Steel | Chemical Composition (in mass %, balance being Fe and impurities) | | | | | | | | | | | | |
|---|---|---|---|---|---|---|---|---|---|---|---|---|---|
| type | C | Si | P | S | Mn | Cr | Ni | Al | N | V | Nb | Mo | W |
| A | 0.024 | 0.42 | 0.012 | 0.001 | 4.82 | 22.4 | 12.3 | 0.03 | 0.34 | 0.15 | 0.15 | 2.21 | — |
| B | 0.017 | 0.42 | 0.017 | 0.001 | 5.40 | 20.4 | 12.7 | 0.018 | 0.28 | 0.21 | 0.23 | — | 2.45 |
| C | 0.008 | 0.45 | 0.013 | <0.001 | 4.72 | 18.3 | 13.8 | 0.023 | 0.26 | 0.23 | 0.24 | 2.37 | — |
| D | 0.009 | 0.48 | 0.014 | <0.001 | 4.55 | 16.1 | 14.5 | 0.021 | 0.21 | 0.28 | 0.29 | — | — |
| E | 0.042 | 0.39 | 0.007 | 0.003 | 5.23 | 15.1 | 15.1 | 0.026 | 0.33 | 0.31 | 0.33 | 2.17 | — |
| F | 0.053 | 0.35 | 0.009 | <0.001 | 5.70 | 21.3 | 15.8 | 0.019 | 0.37 | 0.22 | 0.08 | — | — |
| G | 0.064 | 0.36 | 0.013 | 0.001 | 6.23 | 19.7 | 16.1 | 0.022 | 0.17 | 0.12 | 0.03 | 2.12 | — |
| H | 0.071 | 0.65 | 0.014 | 0.002 | 6.45 | 24.3 | 16.9 | 0.017 | 0.19 | 0.19 | 0.24 | 2.24 | — |
| I | 0.081 | 0.72 | 0.007 | <0.001 | 6.88 | 23.3 | 12.4 | 0.027 | 0.21 | 0.37 | 0.43 | 1.23 | 2.83 |
| J | 0.097 | 0.78 | 0.009 | 0.001 | 5.53 | 21.8 | 14.2 | 0.023 | 0.16 | 0.41 | 0.31 | 2.25 | — |
| K | 0.034 | 0.81 | 0.008 | 0.002 | 4.23 | 17.6 | 13.4 | 0.014 | 0.13 | 0.53 | 0.49 | — | — |
| L | 0.023 | 0.41 | 0.01 | 0.001 | 4.53 | 22.2 | 10.23 | 0.017 | 0.31 | 0.21 | 0.16 | — | — |
| M | 0.027 | 0.43 | 0.012 | 0.001 | 4.68 | 22.7 | 8.85 | 0.014 | 0.29 | 0.19 | 0.18 | 2.5 | — |
| N | 0.034 | 0.42 | 0.011 | 0.001 | 4.88 | 21.9 | 9.53 | 0.018 | 0.3 | 0.18 | 0.21 | — | — |
| O | 0.031 | 0.42 | 0.01 | <0.001 | 4.47 | 21.8 | 11.74 | 0.016 | 0.32 | 0.19 | 0.19 | 2.18 | — |
| P | 0.023 | 0.39 | 0.011 | <0.001 | 2.91 | 21.4 | 12.6 | 0.019 | 0.08 | 0.21 | 0.23 | 2.15 | — |
| Q | 0.021 | 0.41 | 0.009 | 0.001 | 4.50 | 21.8 | 13.2 | 0.023 | 0.07 | 0.18 | 0.19 | — | — |
| R | 0.031 | 0.41 | 0.011 | 0.001 | 4.85 | 21.8 | 12.1 | 0.02 | 0.32 | — | — | 2.17 | — |

The blocks were hot-rolled to a predetermined thickness to provide steel materials. Each of the steel materials was subjected to the solution treatment, cold working, secondary heat treatment, and secondary cold working under the conditions shown in Table 2 to provide a plate with a thickness of 8 mm. The holding time for each of the solution treatment and secondary heat treatment was one hour. Cold rolling was performed as each of the cold working and secondary cold working.

TABLE 2

| Test No. | Steel type | Solution treatment temperature (° C.) | Reduction in area for cold working (%) | Secondary heat treatment temperature (° C.) | Tensile strength after secondary heat treatment (MPa) | Reduction in area for secondary cold working (%) | Tensile strength after secondary cold working (MPa) | Minor axis/major axis | Grain size number after secondary heat treatment | Relative breaking elongation (%) | Relative fatigue life (%) | Fatigue life in hydrogen (cycles) | Fatigue life in argon (cycles) | Grain size number after secondary cold working |
|---|---|---|---|---|---|---|---|---|---|---|---|---|---|---|
| 1 | A | 1200 | 25 | 1100 | 808 | 40 | 1123 | 0.18 | 8.6 | 98 | 71 | 16670 | 23479 | 8.8 |
| 2 | A | 1100 | 25 | 1050 | 821 | 40 | 1186 | 0.16 | 9.0 | 99 | 72 | 17769 | 24679 | 9.2 |
| 3 | A | 1050 | 25 | 1000 | 838 | 40 | 1221 | 0.18 | 10.7 | 94 | 73 | 21785 | 29843 | 11.0 |
| 4 | A | 1100 | 20 | 1000 | 837 | 40 | 1245 | 0.17 | 10.9 | 91 | 71 | 22350 | 31479 | 11.2 |
| 5 | A | 1100 | 25 | 1000 | 834 | 60 | 1457 | 0.11 | 10.3 | 92 | 71 | 32183 | 45328 | 10.6 |
| 6 | B | 1100 | 25 | 1000 | 816 | 60 | 1421 | 0.13 | 10.0 | 89 | 74 | 32174 | 43479 | 10.2 |
| 7 | C | 1100 | 25 | 1000 | 811 | 60 | 1418 | 0.13 | 10.0 | 92 | 72 | 30851 | 42848 | 10.3 |
| 8 | D | 1100 | 25 | 1000 | 807 | 60 | 1386 | 0.14 | 9.4 | 93 | 73 | 30366 | 41597 | 9.7 |
| 9 | E | 1100 | 25 | 1000 | 834 | 60 | 1434 | 0.13 | 10.6 | 88 | 74 | 32722 | 44219 | 10.9 |
| 10 | F | 1100 | 25 | 1000 | 847 | 60 | 1448 | 0.12 | 10.3 | 89 | 72 | 32934 | 45741 | 10.5 |
| 11 | G | 1100 | 25 | 1000 | 804 | 60 | 1423 | 0.14 | 9.8 | 91 | 73 | 31986 | 43816 | 10.1 |
| 12 | H | 1100 | 25 | 1000 | 834 | 60 | 1453 | 0.13 | 10.8 | 88 | 75 | 34117 | 45489 | 10.6 |
| 13 | I | 1100 | 25 | 1000 | 837 | 60 | 1474 | 0.12 | 10.4 | 92 | 76 | 36.34 | 47413 | 10.7 |
| 14 | J | 1100 | 25 | 1000 | 806 | 60 | 1426 | 0.14 | 9.9 | 94 | 74 | 31960 | 43189 | 10.2 |
| 15 | K | 1100 | 25 | 1000 | 802 | 60 | 1409 | 0.13 | 9.3 | 93 | 72 | 29501 | 40974 | 9.5 |
| 16 | A | 1100 | 25 | 1000 | 837 | 80 | 1576 | 0.08 | 10.3 | 74 | 59 | 26636 | 45146 | 10.5 |
| 17 | A | 1100 | 25 | 1000 | 837 | 70 | 1528 | 0.1 | 9.6 | 64 | 41 | 16895 | 41208 | 9.9 |
| 18 | A | 1250 | 25 | 1000 | 724 | 40 | 1087 | 0.18 | 7.6 | 63 | 56 | 12313 | 21987 | 7.8 |
| 19 | A | 1100 | 25 | 850 | 738 | 40 | 1186 | 0.18 | 7.6 | 53 | 51 | 11979 | 23489 | 7.8 |
| 20 | L | 1100 | 25 | 1000 | 719 | 60 | 1089 | 0.1 | 10.2 | 79 | 68 | 14086 | 20714 | 10.4 |
| 21 | M | 1100 | 25 | 1000 | 723 | 60 | 1101 | 0.12 | 9.7 | 77 | 63 | 14231 | 22589 | 10.0 |
| 22 | N | 1100 | 25 | 1000 | 731 | 60 | 1143 | 0.13 | 9.4 | 78 | 61 | 14193 | 23267 | 9.7 |
| 23 | O | 1100 | 25 | 1000 | 743 | 60 | 1214 | 0.12 | 9.6 | 76 | 64 | 18302 | 28597 | 9.9 |
| 24 | P | 1100 | 25 | 1000 | 698 | 60 | 984 | 0.13 | 10.0 | 75 | 67 | 11954 | 17842 | 10.2 |
| 25 | Q | 1100 | 25 | 1000 | 689 | 60 | 974 | 0.14 | 9.9 | 75 | 68 | 11856 | 17435 | 10.1 |
| 26 | R | 1100 | 25 | 1000 | 775 | 30 | 987 | 0.1 | 7.7 | 79 | 58 | 11821 | 20447 | 9.1 |
| 27 | R | 1100 | 25 | 1000 | 775 | 40 | 1078 | 0.09 | 7.7 | 78 | 53 | 13589 | 25468 | 8.8 |
| 28 | R | 1100 | 25 | 1000 | 775 | 60 | 1124 | 0.08 | 7.7 | 77 | 52 | 14574 | 27810 | 8.6 |

[Observation of Microstructure]

From the obtained plates, samples were extracted for allowing observation of cross sections parallel to the direction of rolling and the thickness direction and were embedded in resin, and were corroded in a mixed acid (hydrochloric acid to nitric acid=1:1), before their crystal grain size numbers were measured in accordance with ASTM E 112. Further, in each of these samples, the ratio of the minor axis to the major axis of austenite crystal grains (minor axis/major axis) was determined. After the secondary heat treatment, samples were similarly extracted from the plates before the secondary cold working and their crystal grain size numbers were measured.

[Tensile Strength and Breaking Elongation]

Round-rod tensile-test specimens extending in the longitudinal direction of the plates and with a parallel portion having a diameter of 3 mm were extracted, and tensile tests were conducted in the atmosphere at room temperature or in a high-pressure hydrogen gas at 85 MPa at room temperature, at a strain rate of $3\times10^{-6}$/s to measure tensile strength and breaking elongation. Since a significant influence of hydrogen is a decrease in toughness, the ratio of breaking elongation in hydrogen relative to breaking elongation in the atmosphere was treated as relative breaking elongation, and a steel with a relative breaking elongation of 80% or higher, preferably 90% or higher was considered to have a negligible decrease in ductility due to hydrogen and have good hydrogen-environment embrittlement resistance.

[Fatigue Life]

Tubular fatigue test specimens extending in the longitudinal direction of the plates and with an outer diameter of 7.5 mm were extracted, and fatigue tests were conducted in argon gas at room temperature or in a high-pressure hydrogen gas at 85 MPa at room temperature to measure fatigue life. The number of cycles that have occurred when a crack originating from the inner surface of a specimen reached the outer surface was treated as fatigue life. Since a significant influence of hydrogen is a decrease in fatigue life, the ratio of the fatigue life in hydrogen relative to the fatigue life in argon was treated as relative fatigue life, and a steel with a relative fatigue life of 70% or higher was considered to have a negligible decrease in fatigue life due to hydrogen and have good hydrogen fatigue resistance.

[Test Results]

The values of the tensile strength after the secondary heat treatment, the tensile strength after the secondary cold working, the ratio of the minor axis to the major axis of austenite crystal grain, the crystal grain size number of austenite crystal grains after the secondary heat treatment, relative breaking elongation, relative fatigue life, fatigue life in hydrogen, fatigue life in argon, and crystal grain size number of austenite crystal grains after the secondary cold working are listed in Table 2 provided above.

In each of Test Nos. 1 to 15, the ratio of the minor axis to the major axis of austenite crystal grains was larger than 0.1, the crystal grain size number of austenite crystal grains after the secondary cold working was not lower than 8.0, and the tensile strength was not lower than 1000 MPa, and at the same time the relative breaking elongation was not less than 80% and the relative fatigue life was not less than 70%, exhibiting sufficient hydrogen embrittlement resistance and hydrogen fatigue resistance.

In each of Test Nos. 16 and 17, the relative breaking elongation and relative fatigue life were small. This is presumably because the ratio of the minor axis to the major axis of austenite crystal grains was not higher than 0.1, i.e. because of anisotropy of crystal grains. Further, the ratio of the minor axis to the major axis of austenite crystal grains was not higher than 0.1 presumably because the reduction in area for the secondary cold working was too high.

In Test No. 18, the relative breaking elongation and relative fatigue life were small. This is presumably because the crystal grains were coarse. The crystal grains were coarse presumably because the solution treatment temperature was too high.

In Test No. 19, the relative breaking elongation and relative fatigue life were small. This is presumably because the crystal grains were coarse. The crystal grains were coarse presumably because the secondary heat treatment temperature was too low, precipitating $Cr_2N$.

In each of Test Nos. 20 to 23, the relative breaking elongation and relative fatigue life were small. This is presumably because the Ni contents in steel types L, M, N and O were too low and the stability of austenite after the cold working was not ensured.

In each of Test Nos. 24 and 25, the tensile strength was lower than 1000 MPa and the relative breaking elongation and relative fatigue life were small. In steel type P for Test No. 24, the Mn content was too low and, as a result, a sufficient amount of N was not contained. In steel type Q for Test No. 25, the N content was too low. In either case, the solute strengthening due to N was insufficient, resulting in insufficient tensile strength.

In each of Test Nos. 26 to 28, the relative breaking elongation and relative fatigue life were small. This is presumably because the ratio of the minor axis to the major axis of austenite crystal grains was not higher than 0.1, i.e. because of anisotropy of crystal grains. The ratio of the minor axis to the major axis of austenite crystal grains was not higher than 0.1 presumably because steel type R for Test Nos. 26 to 28 contained no Nb and no V and thus the pinning effect by carbonitrides was not obtained.

Figure 2:
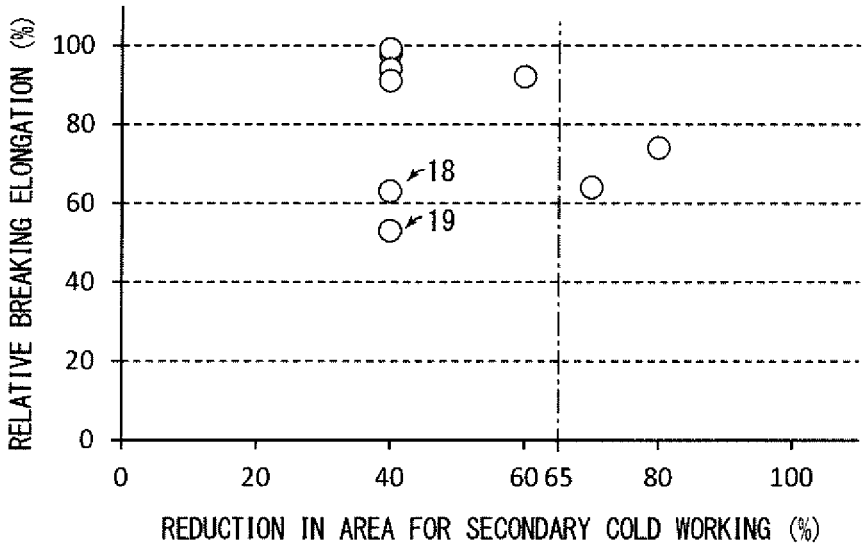
FIG. 2 is a scatter diagram showing the relationship between reduction in area in the secondary cold working and relative breaking elongation.

FIG. 2 is a scatter diagram showing the relationship between reduction in area in the secondary cold working and relative breaking elongation. FIG. 2 was created by extracting, from Table 2, data of the same steel type (i.e. steel type A). FIG. 2 shows that, if reduction in area is not higher than 65%, a relative breaking elongation of 80% or higher can be obtained in a stable manner. Further, it shows that, even if reduction in area is lower than 65%, relative breaking elongation is low if solution treatment temperature is too high (Test No. 18) or secondary heat treatment temperature is too low (Test No. 19).

Figure 3:
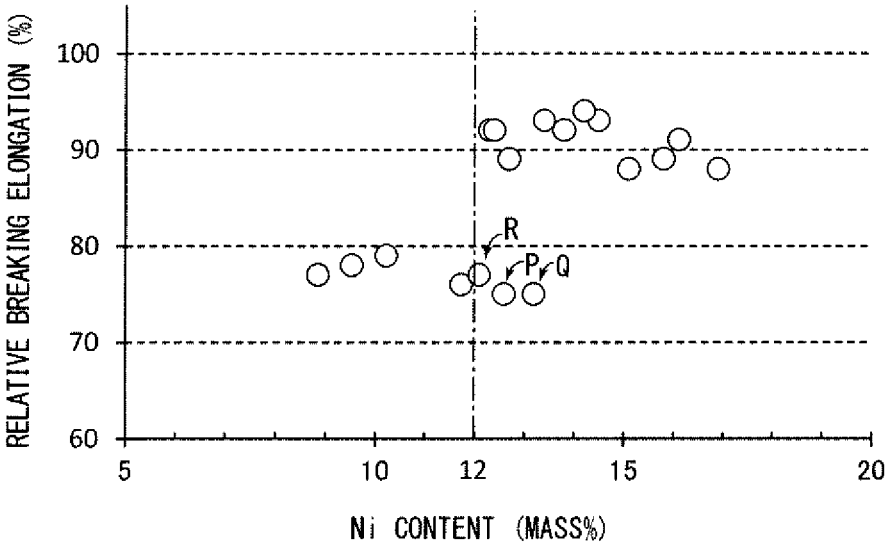
FIG. 3 is a scatter diagram showing the relationship between Ni content and relative breaking elongation.

FIG. 3 is a scatter diagram showing the relationship between Ni content and relative breaking elongation. FIG. 3 was created by extracting, from Table 2, data with the same reduction in area (60%) in the secondary cold working. FIG. 3 shows that, if Ni content is not lower than 12.0%, relative breaking elongation is significantly large. Further, it shows that, even if Ni content is not lower than 12.0%, relative breaking elongation is low if N content is too low (steel types P and Q). Further, it shows that, even if Ni content is not lower than 12.0%, relative breaking elongation is small if no Nb or V is contained (steel type R).

Figure 4:
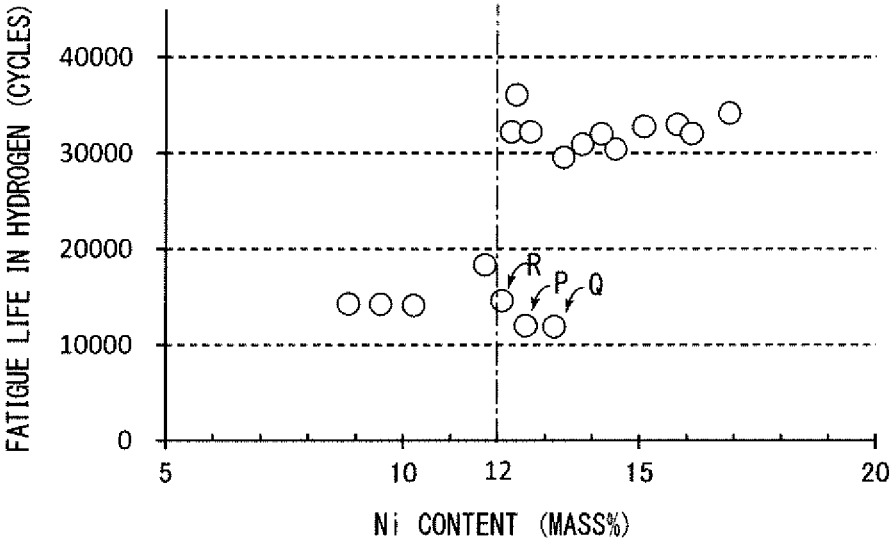
FIG. 4 is a scatter diagram showing the relationship between Ni content and fatigue life in hydrogen.

FIG. 4 is a scatter diagram showing the relationship between Ni content and fatigue life in hydrogen. FIG. 4 was created by extracting, from Table 2, data with the same reduction in area (60%) in the secondary cold working. FIG. 4 shows that, if Ni content is not lower than 12.0%, fatigue life in hydrogen is significantly long. Further, it shows that, even if Ni content is not lower than 12.0%, fatigue life in hydrogen is short if N content is too low (steel types P and Q). Further, it shows that, even if Ni content is not lower than 12.0%, fatigue life in hydrogen is short if no Nb or V is contained (steel type R).

INDUSTRIAL APPLICABILITY

The present invention provides a high-strength austenitic stainless steel with a good hydrogen embrittlement resistance and hydrogen fatigue resistance which are required of a member for use in high-pressure hydrogen that is used without welding, for example.

The invention claimed is:

1. An austenitic stainless steel having a chemical composition consisting of, in mass %, C: up to 0.10%;
Si: up to 1.0%;
Mn: not less than 3.0% and less than 7.0%;
Cr: 15 to 30%;
Ni: not less than 12.0% and less than 17.0%;
Al: up to 0.10%;
N: 0.10 to 0.50%;
P: up to 0.050%;
S: up to 0.050%;
at least one of V: 0.01 to 1.0% and Nb: 0.01 to 0.50%;
Mo: 0 to 3.0%;
W: 0 to 6.0%;
Ti: 0 to 0.5%;
Zr: 0 to 0.5%;
Hf: 0 to 0.3%;
Ta: 0 to 0.6%;
B: 0 to 0.020%;
Cu: 0 to 5.0%;
Co: 0 to 10.0%;
Mg: 0 to 0.0050%;
Ca: 0 to 0.0050%;
La: 0 to 0.20%;
Ce: 0 to 0.20%;
Y: 0 to 0.40%;
Sm: 0 to 0.40%;
Pr: 0 to 0.40%;
Nd: 0 to 0.50%; and
the balance being Fe and impurities, the steel having an austenite crystal grain with a ratio of a minor axis to a major axis that is greater than 0.1, the austenite crystal grain having a crystal grain size number in accordance with ASTM E 112 that is not lower than 8.0, the steel having a tensile strength that is not less than 1000 MPa, wherein the steel has $0.4/\mu m^2$ or more particles of alloying carbonitrides with a dimension of 50 to 1000 nm.

2. The austenitic stainless steel according to claim 1, wherein the chemical composition has one or more elements selected from the group consisting of, in mass %, Mo: 0.3 to 3.0%, W: 0.3 to 6.0%, Ti: 0.001 to 0.5%, Zr: 0.001 to 0.5%, Hf: 0.001 to 0.3%, Ta: 0.001 to 0.6%, B: 0.0001 to 0.020%, Cu: 0.3 to 5.0%, Co: 0.3 to 10.0% Mg: 0.0001 to 0.0050%, Ca: 0.0001 to 0.0050%, La: 0.0001 to 0.20%, Ce: 0.0001 to 0.20%, Y: 0.0001 to 0.40%, Sm: 0.0001 to 0.40%, Pr: 0.0001 to 0.40% and Nd: 0.0001 to 0.50%.

3. A method of manufacturing the austenitic stainless steel of claim 1, comprising the steps of:

preparing a steel material having a chemical composition consisting of, in mass %, C: up to 0.10%; Si: up to 1.0%; Mn: not less than 3.0% and less than 7.0%; Cr: 15 to 30%; Ni: not less than 12.0% and less than 17.0%; Al: up to 0.10%; N: 0.10 to 0.50%; P: up to 0.050%; S: up to 0.050%; at least one of V: 0.01 to 1.0% and Nb: 0.01 to 0.50%; Mo: 0 to 3.0%; W: 0 to 6.0%; Ti: 0 to 0.5%; Zr: 0 to 0.5%; Hf: 0 to 0.3%; Ta: 0 to 0.6%; B: 0 to 0.020%; Cu: 0 to 5.0%; Co: 0 to 10.0%; Mg: 0 to 0.0050%; Ca: 0 to 0.0050%; La: 0 to 0.20%; Ce: 0 to 0.20%; Y: 0 to 0.40%; Sm: 0 to 0.40%; Pr: 0 to 0.40%; Nd: 0 to 0.50%; and the balance being Fe and impurities;

performing a solution treatment on the steel material at a solution treatment temperature of 1000 to 1200° C.;

cold working the steel material that has undergone the solution treatment with a reduction in area that is not lower than 20%;

performing a heat treatment on the steel material that has been cold-worked at a temperature that is not lower than 900° C. and lower than the solution treatment temperature; and cold working the steel material that has undergone the heat treatment with a reduction in area that is not lower than 10% and lower than 65%.

* * * * *